United States Patent [19]

Schonwald et al.

[11] 4,194,798

[45] Mar. 25, 1980

[54] SIDE CHANNEL COMPRESSOR WITH AT LEAST ONE BEARING ARRANGED AT THE HOUSING COVER OF THE SIDE CHANNEL COMPRESSOR

[75] Inventors: Siegfried Schönwald; Rudolf Schöning; Eberhard Breyer, all of Bad Neustadt; Gert Hecht, Bremen, all of Fed. Rep. of Germany

[73] Assignee: Siemens Aktiengesellschaft, Berlin and Munich, Fed. Rep. of Germany

[21] Appl. No.: 888,734

[22] Filed: Mar. 21, 1978

[30] Foreign Application Priority Data

Mar. 24, 1977 [DE] Fed. Rep. of Germany ..... 2713091

[51] Int. Cl.[2] ..... F04D 23/00

[52] U.S. Cl. ..... 308/189 R; 308/245; 415/53 T; 415/213 T

[58] Field of Search ..... 308/189 R, 245, 9, DIG. 15, 308/187, DIG. 1, 15, 236, 72, 74–75, 76–77; 415/53 T, 213 T

[56] References Cited

U.S. PATENT DOCUMENTS 3,694,101 9/1972 Rumsey ..... 415/213 T

FOREIGN PATENT DOCUMENTS 2228326 12/1973 Fed. Rep. of Germany ..... 415/53 T

*Primary Examiner*—Douglas C. Butler

*Attorney, Agent, or Firm*—Kenyon & Kenyon

[57] ABSTRACT

In a side channel compressor having a housing cover and a bearing arranged at the housing cover, the improvement wherein the compressor is further provided with a separate bearing cap which is fastened to the housing cover and within which is disposed the bearing and with a centering rim on the cover for aligning the cap.

5 Claims, 3 Drawing Figures

SIDE CHANNEL COMPRESSOR WITH AT LEAST ONE BEARING ARRANGED AT THE HOUSING COVER OF THE SIDE CHANNEL COMPRESSOR

BACKGROUND OF THE INVENTION

1. Field of the Invention

The invention relates to a side channel compressor having a housing cover and at least one bearing arranged at the cover.

2. Description of the Prior Art

In side channel compressors of the above type, the bearing is arranged in a bearing bore formed in the housing cover. As a result, if during the operation of the side channel compressor, the housing and thereby also the housing cover become heated up, the heat of the housing cover is fully transferred to the bearing. The bearing thus undergoes a substantial temperature rise which has a detrimental effect on the lubricant placed in the bore of the bearing for permanent lubrication.

It is, therefore, an object of the present invention to provide a side channel compressor of the above-type wherein the bearing of the compressor is maintained at a temperature substantially reduced from that of the housing cover.

SUMMARY OF THE INVENTION

In accordance with the principles of the present invention, the above and other objectives are realized in a side channel compressor of the above-type by further providing therein a separate bearing cap which is fastened to the housing cover and within whose bore the bearing is arranged and with means for aligning the bearing within the cap.

With the compressor so arranged, the separate bearing cap is in heat-conducting contact with the housing cover through substantially only the alignment means and the fastening points. This greatly reduces the heat flow from the housing cover to the bearing cap. More particularly, since more heat can be transferred to the ambient air via the surface of the bearing cap than can be replenished via the small contact area between the bearing cap and the housing cover, the bearing cap is heated up less than the housing cover. The temperature rise of the bearing is thereby reduced substantially.

Advantageously, the aforesaid temperature rise of the bearing can be reduced further by additionally providing a shield with cooling fins at the bearing cap. Such a shield allows the cap to give off even more heat to the ambient air, which reduces the temperature rise of the bearing still further.

Also advantageously, the alignment means can be easily provided by forming same from a centering rim on the housing cover, the diameter of such rim being selected to be equal to the outside diameter of the bearing. In such case, the centering of the bearing cap at the housing cover is accomplished by the bearing bore and the centering rim. Moreover, with this arrangement, the heat flow from the housing cover to the bearing cap and, hence, to the bearing, can be reduced further by selecting the radial thickness of the centering rim to be less than the thickness of the outer ring of the bearing and/or by providing axially extending cutouts in the rim. By these further modifications, the contact area between the housing cover and the bearing cap is decreased and the transfer of heat from the housing cover to the cap thus further impeded.

BRIEF DESCRIPTION OF THE DRAWING

The above and other features and aspects of the present invention will become more apparent upon reading the following detailed description in conjunction with the accompanying drawings, in which.

DETAILED DESCRIPTION

Figure 1:
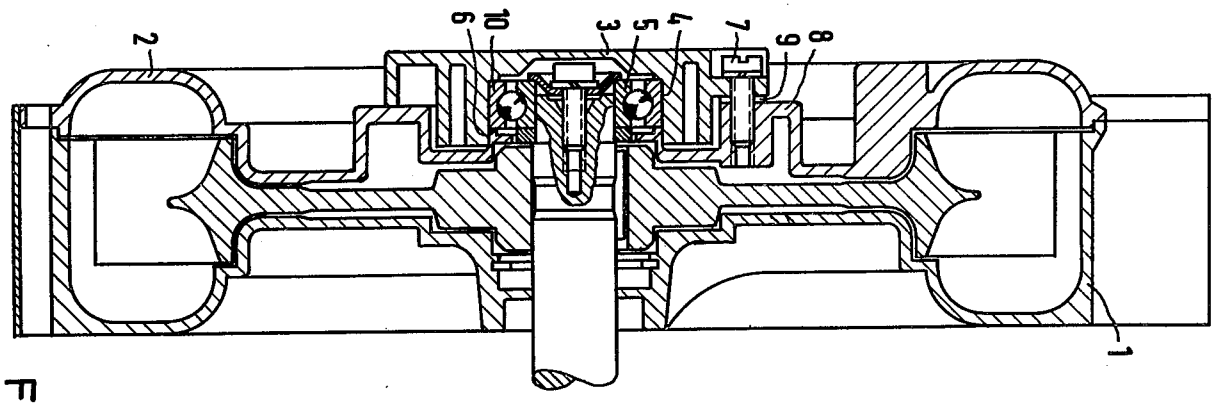
FIG. 1 shows a first embodiment of a side channel compressor in accordance with the principles of the present invention.

FIG. 1 shows a side channel compressor 1 having a housing cover 2 to which is attached a separate bearing cap 3. The bearing cap 3 is provided with a bearing bore 4 into which is inserted a ball bearing 5. The housing cover 2 is further provided with a centering shoulder or rim 6 onto which the bearing cap 3 is pushed, whereby the cap becomes centered relative to the housing cover. The bearing cap is held at appropriate fastening locations 8 of the housing cover 2 by means of fastening screws 7. Insulating washers 9 are inserted at the interface between the fastening locations 8 and the bearing cap, the latter washers being formed of a poor heat-conducting material so as to inhibit heat transfer between the cap cover. To further limit such heat transfer, the radial thickness of the centering rim 6 has been made less than the thickness of the outer ring 10 of the ball bearing 5. This substantially reduces the contact area between the outer ring 10 of the ball bearing and the centering rim, so that the heat transfer from the housing cover to the ball bearing 5 is inhibited.

Figure 3:
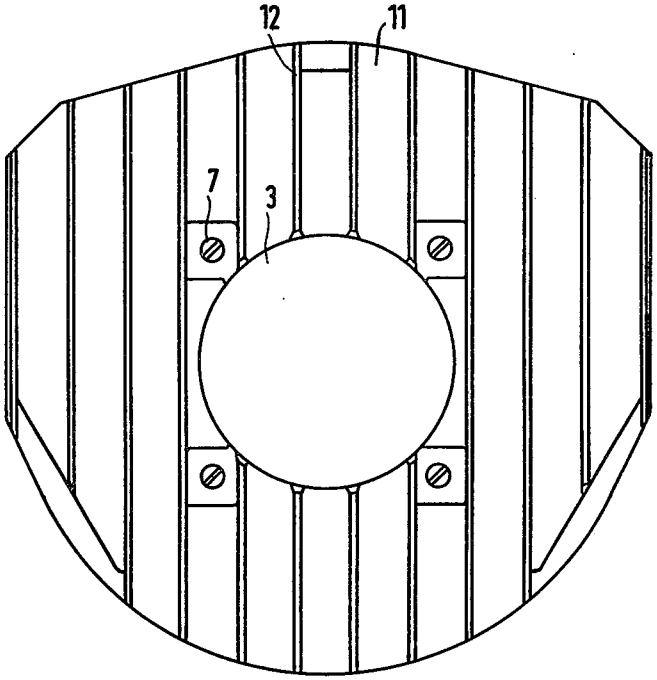
FIG. 3, shows a front view of the bearing cap shown in FIG. 2.
Figure 2:
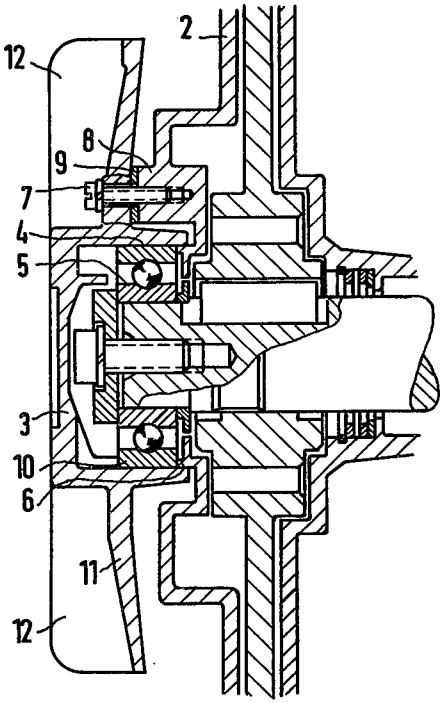
FIG. 2 illustrates a modified form of the bearing cap of the compressor in FIG. 1.

FIGS. 2 and 3 show side and front views of a modification of the bearing cap 3 of FIG. 1, wherein the cap is provided with a shield 11 having cooling fins 12. With this configuration of the cap the shield 11 and the cooling fins 12 provide the cap with a larger area for radiating heat, so that the little heat which passes to the cap is better transferred therefrom to the ambient air. This permits a further reduction in the temperature rise of the bearing cap and, thus, of the ball bearing 5.

In summary, therefore, in the side channel compressor of the present invention, the provision of a separate bearing cap 3 permits the ball bearing 5 to be arranged outside the housing cover 2. As a result, heat can be transferred to the bearing 5 only via the contact area between the cap 3, the outer ring 10 of the ball bearing 5 and the centering rim 6 of the housing cover 2. Due to the fact that the bearing cap 3 only slightly overlaps the centering rim 6 and the radial thickness of the centering rim 6 is smaller than the thickness of the outer ring 10, the resultant contact area for heat transfer from the cover 2 to the bearing is kept quite small. This alone inhibits a substantial part of the heat given off by the housing cover 2 from being transferred to the ball bearing 5. By the increased heat removal provided by the shield 11 and the cooling fins 12, the temperature rise of the ball bearing 5 is held substantially lower than the temperature rise of the housing cover 2.

What is claimed is:

1. In a side channel ring compressor having a housing cover and a ball bearing arranged at said housing cover, the improvement comprising:

(a) a separate bearing cap, said bearing cap having a bore therein, said bearing arranged wholly within said bore such that the radial periphery of said bearing contacts only said bore, said bearing cap attached to said cover at a plurality of circumferentially spaced fastening locations;

(b) a centering rim on said housing cover; and (c) a layer of insulation inserted between said cover and said bearing cup at said fastening locations, said layer being formed of a material which is a poor heat conductor so as to inhibit heat transfer from said cover to said cap, whereby the transfer of heat from said cover to said bearing will be minimized thereby avoiding a substantial temperature rise which could have a detrimental effect on lubricant for said bearing.

2. The improvement according to claim 1 wherein said centering rim has a diameter equal to the outer diameter of said ball bearing.

3. The improvement according to claim 2 wherein said ball bearing has an outer race and wherein the radial thickness of said centering rim is smaller than the radial thickness of said outer race.

4. The improvement according to claim 2 wherein said centering rim has cutouts extending in the axial direction.

5. The improvement according to claim 1 wherein said bearing cap is attached at said plurality of fastening locations by means of bolts and wherein said layer of insulation comprises insulating washers inserted between said cover and said bearing cap at said fastening locations.

* * * * *